United States Patent [19]

Ehrlich

[11] Patent Number: 4,672,754

[45] Date of Patent: Jun. 16, 1987

[54] SHOE SOLE

[75] Inventor: Johann Ehrlich, Krems, Austria

[73] Assignee: Patoflex Corporation, Cave Creek, Ariz.

[21] Appl. No.: 902,049

[22] Filed: Aug. 26, 1986

Related U.S. Application Data

[63] Continuation of Ser. No. 642,186, Aug. 17, 1984, abandoned.

[30] Foreign Application Priority Data

Aug. 18, 1983 [AT] Austria ..... 2962/83

[51] Int. Cl.[4] ..... A43B 1/08

[52] U.S. Cl. ..... 36/85; 36/31; 36/103

[58] Field of Search ..... 36/85, 86, 87, 103, 36/31, 84, 30 R, 30 A

[56] References Cited

U.S. PATENT DOCUMENTS

| | | | |
|---|---|---|---|
| 2,798,312 | 7/1957 | Muller | 36/87 |
| 4,030,155 | 6/1977 | Azadian et al. | 36/86 |
| 4,348,821 | 9/1982 | Daswick | 36/103 |
| 4,400,894 | 8/1983 | Ehrlich | 36/86 |
| 4,510,702 | 4/1985 | Erhlich | 36/86 |

FOREIGN PATENT DOCUMENTS

| | | | |
|---|---|---|---|
| 0036408 | 9/1981 | European Pat. Off. | 36/103 |
| 0048965 | 4/1982 | European Pat. Off. | 36/88 |
| 0102968 | 9/1978 | German Democratic Rep. | 36/84 |
| 2322902 | 11/1974 | Japan | 36/86 |
| 0060380 | 5/1979 | Japan | 36/86 |
| WO83/04166 | 12/1983 | PCT Int'l Appl. | 36/103 |
| 2092431 | 8/1982 | United Kingdom | 36/31 |

*Primary Examiner*—Werner H. Schroeder
*Assistant Examiner*—Mary A. Elbs
*Attorney, Agent, or Firm*—Salter & Michaelson

[57] ABSTRACT

A shoe sole comprising a front sole portion passing over into a rear sole portion via an intermediate sole portion consists of an upper sole portion, being formed at the top surface of the sole facing the sole of the foot at least partially of wood or wood like materials, and of a lower sole portion connected with the bottom surface of the upper sole portion and consisting of an elastic material. The thickness of the lower sole portion within an area of the rear sole portion is, as measured in normal direction to the top surface of the sole, at least 1.5 times, preferably twice, the thickness of the lower sole portion within the area of the front sole portion. Furthermore, the thickness of the lower sole portion within the area of the rear sole portion is, as measured in normal direction to the top surface of the sole, at least one-third of the thickness of the upper sole portion within the area of the rear sole portion, the thickness of the lower sole portion within the area of the rear sole portion being conveniently at least the same, or is even greater, than is the thickness of the upper sole portion within the area of the rear sole portion. The lower sole portion has the properties of a running sole at least within the area of the rear sole portion and is applied to the upper sole portion by forming operation, preferably by foaming operation.

65 Claims, 6 Drawing Figures

13
14
9
12
18
4
II
II 1
15
9
4
2
5
3
c
18
d
12
7"
a
6
10
8
16
7'
b
8

4
5
11

10
7"

2
5"
3
1
5'
17
4
18
12
6
8
7
8

18
12
4
17
V
V

SHOE SOLE

This is a continuation of application Ser. No. 06/642,186, filed 17 Aug. 84.

BACKGROUND AND SUMMARY OF THE INVENTION

The present invention refers to a shoe sole comprising a front sole portion passing over into a rear sole portion via an intermediate sole portion, the top surface of the sole facing the sole of the foot being at least partially formed of the top surface of an upper sole portion consisting of wood or wood-like materials. This top surface of the sole may have an orthopaedic shape. The intermediate portion has at the top surface of the sole the support of the joint, while the rear sole portion comprises the heel.

There are already known soles consisting of an upper sole portion consisting of wood and of a lower sole portion fixed to the bottom side of the upper sole portion and consisting of an elastic material. As a rule, this lower sole portion forming the running sole is only provided at the area of the front sole portion and at the area of the heel and consists, as compared with the upper sole portion, of a thin part of rubber or polyvinyl chloride. With soles consisting of two wooden parts being connected one with the other by a flexible intermediate portion of polyurethane applied by foaming operation it is already also known to form the sole portion representing the running sole equally of polyurethane and to apply this sole portion integrally with the intermediate portion by foaming operation onto the wooden parts. With all known soles comprising an upper sole portion consisting of wood, also the rear sole portion substantially wholly consists of wood, while only the bottom side of the heel is covered by a thin running patch of elastic material. Soles comprising an upper sole portion consisting of wood have the advantage that they act in a temperature-regulating and humidity-regulating manner and support the foot in an orthopaedically correct manner if, as is known per se, the top surface of the sole is given an orthopaedic shape, i.e. is provided with a support for the inner joint, a support for the outer joint, a toe barrier or the like. However, it is a drawback of soles consisting of wood that they have no shock-absorbing properties and that walking with such soles may result in injury of the joints of the foot and the leg and of the spine, and this in particular if making sudden jumps with such soles or if the ground has an unforeseeable level difference which is not recognized by the wearer of shoes provided with such soles.

There are already also known soles consisting as a whole of an elastic synthetic plastics material acting in a shock-absorbing manner. Such soles have, however, no hygienic properties for the wearer because, for example, they are not humidity-regulating but rather promote the production of foot sweat and do not provide an orthopaedically correct support of the foot.

It is an object of the present invention to provide a shoe sole having good hygienic properties for the wearer and providing an optimum support for the foot with simultaneous preservation of the whole joint system. It is a further object of the invention to design a shoe sole such that the sole has, as least at the particularly important area of the heel, an optimum shock-absorbing property and that it reliably provides a gentle tread. It is a further object of the invention to provide a shoe sole which is highly sound-absorbing and which practically completely avoids clicking noises, which are generated when walking with wooden soles. It is a further object of the invention to provide a shoe sole, the production of which is substantially simplified. In particular, it is intended to make it unnecessary to apply a separate running sole or, respectively, a separate heel patch. It is a further object of the invention to provide a shoe sole in which the rear sole portion mainly consists of a heel applied to the upper sole portion by forming operation and preferably by foaming operation, noting that the heel can be a block heel or a wedge heel. It is a further object of the invention to provide a shoe sole with which such a heel has, in particular if its dimension as seen in normal direction of the top surface of the sole are great, the required stability and an optimum supporting property for the foot at the area of the heel. Finally, it is an object of the invention to provide a shoe sole which has a low weight and thus is easy and comfortable for the wearer. The shoe sole according to the invention shall further have a nice appearance and shape.

BRIEF DESCRIPTION OF THE DRAWING

In the annexed drawing, the invention is schematically illustrated by examples of embodiment.

FIG. 6 is a sectional view of still another embodiment of the shoe sole.

DETAILED DESCRIPTION OF THE DRAWING

Figure 1:
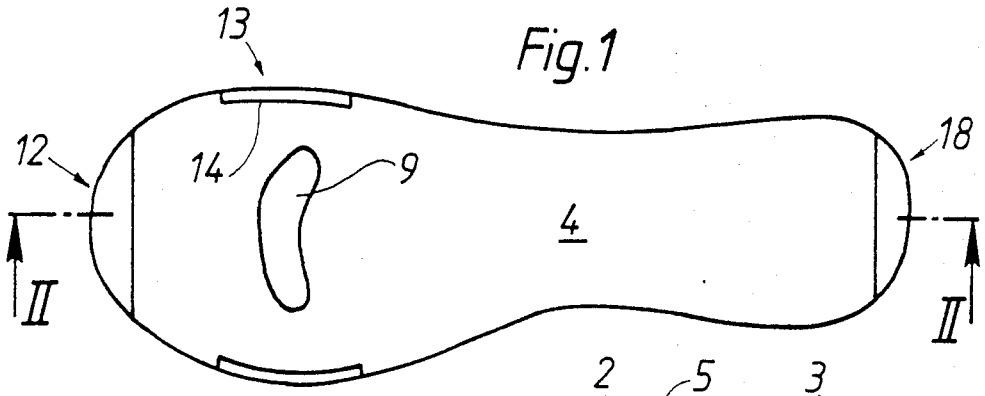
FIG. 1 shows a top plan view of a shoe sole according to the invention.

The shoe sole according to the invention has, like all shoe sles, a front shoe sole protion 1 passing over into a rear sole portion 3 via an intermediate sole portion 2. The top surface 4 of the sole is for its major part formed of the top surface of an upper sole portion 5 consisting of wood and having its bottom surface 6 connected with a lower sole portion 7 consisting of an elastic synthetic plastics material and forming with its bottom surface the running surface 8. The top surface 4 is designed as a support for the joint at the area of the intermediate sole portion 2, and the rear sole portion 3 has the heel. In the embodiment according to the FIGS. 1 and 2, the lower sole portion consists of a section 7' arranged within the area of the front sole portion and of a section 7'' arranged in the area of the heel. The top surface 4 is conveniently given an orthopaedic shape, the drawing showing, for example, the toe barrier 9.

The upper sole portion 5 can, for example, consist of compact wood, the upper sole portion 5 being given its shape by milling operation. In this case it is only necessary for the top surface 4 to be given an orthopaedic shape, while the bottom surface 6 can be a continuous surface which can be obtained in a substantially more simple manner.

The upper sole portion 5 can further consist of small wood particles mutually connected by a binding agent. Also with this embodiment, which is as a rule designated compressed wood or homogenous wood, the upper portion can be given a corresponding shape in a simple manner.

The upper sole portion 5 can, however, also consist of plywood in which case at least three wood layers, preferably five to seven wood layers, are provided. Plywood having the indicated number of wood layers, on the one hand, supports the foot in an orthopaedically correct manner and, on the other hand, can be brought into the desired shape by pressing, noting that on account of the comparatively low number of wood layers one can do with a low pressing pressure and with a short residence time within the press.

Finally, the upper sole portion 5 can also consist of cork, noting that there can be used natural cork as well as compressed cork which consists of small cork particles connected one with the other with a binding agent, for example latex.

The bottom surface 6 of the upper sole portion 5 may have a continuous shape, i.e. not have areas of discontinuity such as corners, edges or the like, so that its production is simplified. On account of the lower sole portion 7 being applied to this bottom surface by forming operation or foaming operation, this bottom surface need not be given a special shape. Preferably, the bottom surface 6 of the upper sole portion 5 continuously extends in upwardly inclined manner in direction to the rear end of the shoe sole, which results also in an optimum shape of the lower sole portion 7 applied to the bottom surface 6 of the upper sole portion 5 by forming or foaming operation.

Figure 2:
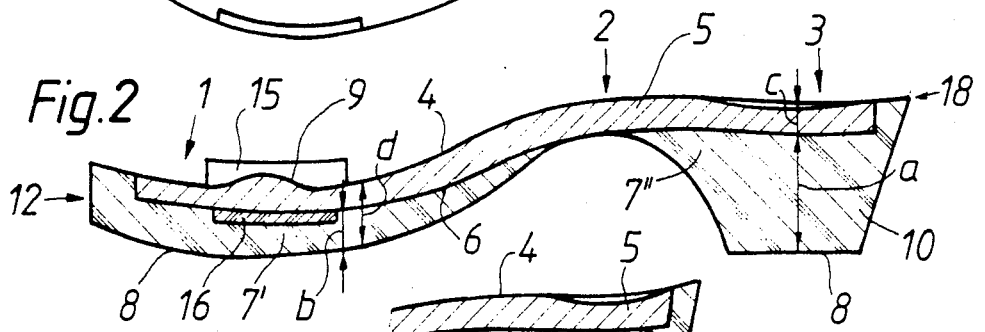
FIG. 2 shows a section along line II—II of FIG. 1.
Figure 3:
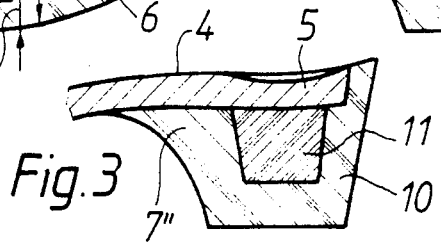
FIG. 3 shows in a section the heel area of a modified embodiment of the shoe sole according to the invention.

As can be taken from FIGS. 2 and 3, the rear sole portion 3 can for its major part consist of a heel 10 forming an integral part with the rear section 7″ of the lower sole portion 7 and simultaneously formed with this sole portion 7.

The lower sole portion 7, i.e. at least its rear section 7″ and preferably also the heel 10 simultaneously formed with this rear section, preferably consist of synthetic plastics material having a cell structure and being applied to the upper sole portion 5 by forming or foaming operation, respectively. The cell structure warrants in an optimum manner the desired elastic shock-absorbing properties. This cell structure of the synthetic plastics material can be obtained by a foaming process but can also be obtained by incorporating into the synthetic plastics material hollow microspheres, the thin shell of which consists of a vinylidene chloride copolymer and the core of which contains a gas. For increasing the number of cells or for obtaining a greater number of closed cells, respectively, it is also possible to additionally incorporate the mentioned hollow microspheres into a foamed synthetic plastics material.

It is of particular advantage if the lower sole portion 7 applied to the upper sole portion 5 by forming or foaming operation, respectively, consists at least within the area of the rear sole portion 3 of polyurethane. Polyurethane becomes exellently connected with the upper sole portion consisting of wood or wood-like materials during foaming operation without the necessity of additional measures, thereby obtaining, on the one hand, a mechanical bond on account of the polyurethane penetrating into the pores of the wood during the foaming process and thus becoming firmly anchored within the wood and, on the other hand, a chemical bond achieved during the chemical reaction of the isocyanate groups of the polyurethane-forming materials with the OH-groups of the wood.

The synthetic plastics material can, for example, be formed of a foamed polyurethane consisting of the reaction product of a polyester base polyol component containing 0.1 to 0.5% water and optionally up to a maximum of 5% of an added inflating agent, for example a hydrogenated hydrocarbon or an other easily volatile compound, and a polyisocyanate, the relative proportions of the polyol component and of the polyisocyanate being within the range of 100:65 and 100:55. The density of such a synthetic plastics material is then between 0.35 and 0.6, in particular between 0.43 and 0.53, preferably at 0.48. The synthetic plastics material can also be formed of a polyurethane obtained by the chemical reaction of a polyether base polyol component containing 0.01 to 0.5% water as well as a maximum amount of 10% of added inflating agent, for example a hydrogenated hydrocarbon or an other easily volatile compound, and of a polyisocyanate, the ratio between polyol component and polyisocyanate being within the range of 100:40 and 100:70. The density of such a synthetic plastics material is then between 0.4 and 0.6, in particular between 0.48 and 0.53, preferably at 0.5.

When using a synthetic plastics material on basis of a polyether as the material for the lower sole portion it is convenient to machine the side surfaces of this lower sole portion together with the side surfaces of the upper sole portion by grinding or milling. Such machining, which is only possible when using a polyurethane produced from a polyol component based on polyether, results in a particularly uniform nice appearance of the sole side surface with respect to shape.

Further, the synthetic plastics material can consist of polybutadiene cross-linked with an isocyanate and having a cell structure obtained by adding, for example, said hollow microspheres. Such a material has the particular advantage that it is resistent against hydrolysis and that it does not take up water.

Finally, the synthetic plastics material may consist of a polyol component based on polyester and/or polyether, of polybutadiene, of polyisocyanate as well as optionally of water and of an inflating agent, i.e. of a mixture of a polyurethane based on polyester or polyether, respectively, and of polybutadiene.

Optimum results are obtained if the lower sole portion has in its unmachined condition, i.e. prior to grinding or milling, a hardness of 40 to 60 Shore A, preferably 45 to 55 Shore A, and in its machined condition, i.e. after grinding or milling, a hardness of 20 to 40 Shore A, preferably 25 to 35 Shore A.

The thickness a of the lower sole portion 7″ within the area of the rear portion 3 of the sole or the heel 10, respectively, is, as measured in normal direction to the upper sole surface 4, at least 1.5-times and preferably at least twice the thickness b of the lower sole portion 7′ within the area of the front sole portion. This thickness a is further at least one third of the thickness c of the upper sole portion 5 within the area of the rear sole portion 3, as measured in normal direction to the upper sole surface 4, and is preferably at least the same as is this thickness c of the upper sole portion 5. Conveniently, the thickness a of the lower sole portion 7″ or the heel 10, respectively, is greater than the thickness c of the upper sole portion 5 within the area of the rear sole portion 3 and is a multiple of this thickness c. This reliably results in the desired elastic support of the foot at the area of the rear sole portion 3 as well as in a shock-absorbing effect at the area of the rear sole portion.

For obtaining a shock-absorbing effect of the shoe sole according to the invention also within the area of the front sole portion 1, the thickness b of the lower sole portion 7 is within the area of the front sole portion 1, as measured in normal direction to the upper sole surface 4, more than half of the total sole thickness d within this area.

Furthermore, the thickness b of the lower sole portion 7 is greater within the area of the front sole portion 1 than within the intermediate sole portion 2, where, of course, the lower sole portion 7 does not contact the floor with its surface 8.

At least the section 7'' of the lower sole portion 7, conveniently also the section 7', are applied to the upper sole portion 5 by forming operation or foaming operation, respectively. In this case, the procedure is such that first the material forming the lower sole portion is filled into a mould and subsequently the upper sole portion 5 is placed into the mould where it becomes rested on a protrusion. Subsequently, the material forming the lower sole portion is allowed to cure or set, said material thus being formed onto the upper sole portion 5 or becomes foamed onto the upper sole portion 5 in case of a foamed synthetic plastics material. Such a procedure allows to produce the shoe sole in an economic manner and results in a nice appearance because no interstices are generated between the upper sole portion 5 and the lower sole portion 7 and a stepless and seamless connection is produced instead. After demoulding the side surface of the sole, i.e. the side surface of the upper sole portion 5 and the side surface of the lower sole portion 7, are conveniently machined by grinding or milling.

On account of the lower sole portion 7 forming the running surface 8, the synthetic plastics material forming this lower sole portion must have the properties of a running sole. For giving the heel 10 simultaneously formed with the lower sole portion 7 the desired elastic properties, a core 11 of an other material than the material of the heel 10 can be provided within this heel 10 (see FIG. 3). Conveniently, this core 11 consists of a material which has a lower elasticity than the material of the heel 10. This increases the stability of the heel 10 for preventing, for example, lateral kinking. In this case, the core 11 may, for example, consist of wood.

It may be convenient to design the core 11 to form one single part with the upper sole portion 5 or at least to firmly connect this core with the upper sole portion 5 for the purpose of facilitating production.

Within the area of the sole tip 12 and/or within the area of the heel edge 18 the lower sole portion 7 may extend upwardly till the upper sole portion 4. Such an arrangement provides a protection of the wooden upper sole portion 5 within the area of the sole tip and/or of the heel by the upwardly extending lower sole portion 7 consisting of elastic material. Thus, those portions of the shoe sole are protected which particularly run the risk of spalling off the wood or the like. Furthermore, a shock-absorbing effect is obtained with this embodiment even if an obstacle is struck by the sole tip 12 or by the heel edge 18. Finally, such an embodiment results in a reduced amount of required wood because no wood is necessary at those areas where the lower sole portion extends in upward direction. Furthermore, the human skin is, with this embodiment, protected in particular at the area of the heel, where, with the upper sole surface being designed as an inwardly vaulted heel bed, the upper edge of the sole side surface may cause under circumstances the formation of welts.

As is shown in FIG. 1 the arrangement can in this case be such that the upper sole portion 5 is delimited at the area of the sole tip 12 and at the heel edge 18 by a straight line to which adjoins the upwardly extending portion. In the embodiment according to FIGS. 4 and 5, this upwardly extending portion is, as seen in a top plan view of the upper sole surface, arcuate and gradually passes over into the side surface of the upper sole portion 5 or of the margin of the sole, respectively.

The lower sole portion may extend in upward direction within that area, i.e. at the area 13 in case of sandals, where the shoe upper is to be fixed through recesses 14 of the upper sole portion 5, i.e. upwardly extend over this upper sole surface 4 at 15. This results in an enlarged lateral boundary surface of the sole at the upwardly extending areas, and this is of advantage for permanently fixing, primarily by adhesives, the shoe upper. In this case the upwardly extending portion is conveniently arranged within recesses provided on the side surface of the upper sole portion, so that the outer surface of this upwardly extending portion is in alignment or flush with the sole side surface and does not protrude.

For obtaining a still better shock-absorbing effect, an intermediate part 16 of a plasticized polybutadiene cross-linked with a polyisocyanate can be arranged within the ball area between the bottom surface 6 of the upper sole portion 5 and the lower sle portion 7 applied by forming operation or foaming operation and be fixed to the upper sole portion, preferably by glueing. In this case, hollow microspheres, the thin shell of which consists of a vinylidene chloride copolymer and the interior of which contains a gas, are preferably provided within this intermediate part.

Figure 5:
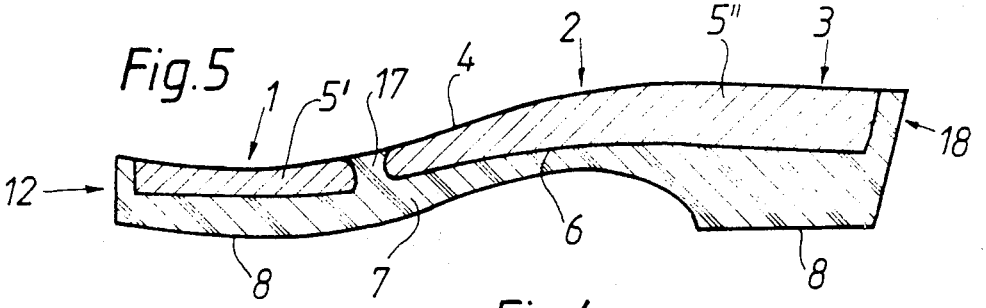
FIG. 4 shows a further embodiment of the shoe sole according to the invention in a top plan view and FIG. 5 shows a section along the line V—V in FIG. 4.
Figure 4:
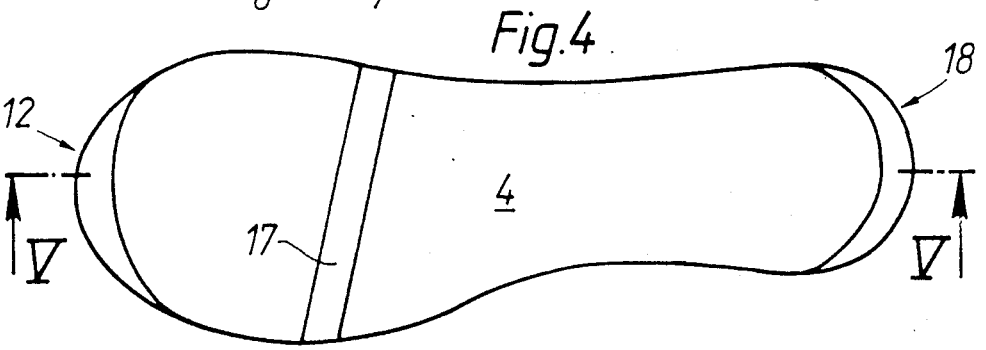

The embodiment according to the FIGS. 4 and 5 further differs from the embodiment according to the FIGS. 1 and 2 by having designed the lower sole portion 7 as a single part extending over the whole bottom surface 6 of the upper sole portion 5. In this embodiment, the upper sole portion 5 consists, however, of two parts 5', 5'' connected one with the other via an intermediate part 17. The intermediate part 17 forms one single part with the lower sole portion 7. This embodiment allows bending movement of the upper sole portion 5 consisting of rigid wood and this at the area of the intermediate part, so that the sole can follow the movements on walking. Also a plurality of intermediate parts 17 can be provided.

Irrespective of the areas of the sole tip 12 and of the heel edge 18 as well as optionally of those areas where are located the upwardly extending parts 15, the upper sole portion 5 extends till the side surface of the sole, so that this side surface of this upper sole portion 5 is visible.

What I claim is:

1. A shoe sole comprising an upper sole portion and a lower sole portion which cooperate to substantially define front, intermediate and rear sections of said shoe sole construction, said upper sole portion consisting of a wood material and having top and bottom surfaces, the top surface of said upper sole portion defining the top surface of said shoe sole at least in the areas where it is contacted by the heel and by the ball of the foot of a wearer, said lower sole portion consisting of an elastic material and having upper and lower surfaces, the bottom surface of said upper sole portion being secured to the upper surface of said lower sole portion by a forming operation at least in the front and rear sections of said shoe sole, the thickness of said lower sole portion in the rear section of said shoe sole being at least 1.5 times the thickness of the lower sole portion in the front section of said shoe sole, the thickness of said lower sole portion in the area of the rear sole portion being at least one third of the thickness of said rear section of the sole, the main portion of the rear section of the lower surface of said lower sole portion being defined by a substantially planar downwardly facing surface, at least the portion of said lower sole portion which is located in the rear section of said shoe sole consisting of a relatively hard, durable, wear-resistant, elastic synthetic plastic material having a cellular structure.

2. Shoe sole as claimed in claim 1, wherein the thickness of the lower sole portion within the area of the rear sole section is, as measured in normal direction to the top surface of the sole, at least twice the thickness of the lower sole portion within the area of the front sole section.

3. Shoe sole as claimed in claim 1, wherein the thickness of the lower sole portion within the area of the rear sole section is, as measured in normal direction to the top surface of the sole, at least equal the thickness of the upper sole portion within the area of the rear sole section.

4. Shoe sole as claimed in claim 1, wherein within the heel a core is arranged which consists of an other material than the material of the heel.

5. Shoe sole as claimed in claim 4, wherein the core consists of a material having a lower elasticity than that of the material of the heel.

6. Shoe sole as claimed in claim 4, wherein the core consists of a material of lower density than that of the material of the heel.

7. Shoe sole as claimed in claim 4, wherein the core forms one single part with the upper sole portion.

8. Shoe sole as claimed in claim 5, wherein the core consists of wood.

9. Shoe sole as claimed in claim 1, wherein the lower sole portion consists of one single piece extending over the whole bottom surface of the upper sole portion.

10. Shoe sole as claimed in claim 1, wherein the thickness of the lower sole portion within the front sole section is, as measured in normal direction to the top surface of the sole, greater than within the area of the intermediate sole section.

11. Shoe sole as claimed in claim 10, wherein the thickness of the lower sole portion within the area of the ball of the front sole section is, as measured in normal direction to the top surface of the sole, greater than within the area of the intermediate sole section.

12. Shoe sole as claimed in claim 1, wherein the thickness of the lower sole portion within the area of the front sole portion is, as measured in normal direction to the top surface, at least more than one third of the total sole thickness.

13. Shoe sole as claimed in claim 1, wherein the upper sole portion consists of compact wood.

14. Shoe sole as claimed in claim 1, wherein the upper sole portion consists of small wood particles being mutually connected one with the other by a binding agent.

15. Shoe sole as claimed in claim 1, wherein the upper sole portion consists of plywood comprising at least three wood layers.

16. Shoe sole as claimed in claim 1, wherein the upper sole portion consists of cork.

17. Shoe sole as claimed in claim 1, wherein the lower sole portion applied to the upper sole portion by forming operation consists of polyurethane at least within the area of the rear sole section.

18. Shoe sole as claimed in claim 1, wherein the synthetic plastics material has incorporated therein hollow microspheres, the thin shell of which consists of a vinylidene chloride copolymer and the core of which contains a gas.

19. Shoe sole as claimed in claim 1, wherein the synthetic plastics material is a foamed polyurethane obtained from a polyol component on basis of polyester and containing 0.1 to 0.5% water and from a polyisocyanate (isocyanate), the ratio between polyol component and isocyanate being between 100:65 and 100:155.

20. Shoe sole as claimed in claim 19, the synthetic plastics material contains an added inflating agent in a maximum amount of 5%.

21. Shoe sole as claimed in claim 20, wherein the added inflating agent consists of a halogenated hydrocarbon.

22. Shoe sole as claimed in claim 20, wherein the added inflating agent consists of an easily volatile compound.

23. Shoe sole as claimed in claim 19, wherein the density of the synthetic plastics material is between 0.35 and 0.6.

24. Shoe sole as claimed in claim 19, wherein the density of the synthetic plastics material is between 0.43 and 0.53.

25. Shoe sole as claimed in claim 19, wherein the density of the synthetic plastics material is 0.48.

26. Shoe sole as claimed in claim 1, wherein the synthetic plastics material is a foamed polyurethane consisting of a polyol component based on polyether and containing 0.01 to 0.5% water as well as of a maximum of 10% of added inflating agent and of a polyisocyanate (isocyanate), the ratio between polyol component and isocyanate being between 100:40 and 100:70.

27. Shoe sole as claimed in claim 26, wherein the added inflating agent consists of halogenated hydrocarbon.

28. Shoe sole as claimed in claim 27, wherein the added inflating agent consists of an easily volatile compound.

29. Shoe sole as claimed in claim 26, wherein the density of the synthetic plastics material is between 0.4 and 0.6.

30. Shoe sole as claimed in claim 26, wherein the density of the synthetic plastics material is between 0.48 and 0.53.

31. Shoe sole as claimed in claim 26, wherein the density of the synthetic plastics material is 0.5.

32. In the shoe sole of claim 26, said lower sole portion comprising a polyether-based plastic material, the side surfaces of said upper and lower sole portions being machined together to provide a uniform side surface configuration in said shoe sole.

33. Shoe sole as claimed in claim 32, wherein the side surfaces of the lower sole portion and the upper sole portion are machined in a grinding operation.

34. Shoe sole as claimed in claim 32, wherein the side surfaces of the lower sole portion and the upper sole portion are machined in a milling operation.

35. Shoe sole as claimed in claim 1, wherein the synthetic plastics material consists of a polybutadiene having a cell structure and being cross-linked with isocyanate.

36. Shoe sole as claimed in claim 35, wherein the synthetic plastics material consists of a polybutadiene cross-linked with isocyanate and comprising a cell structure by incorporating hollow microspheres.

37. Shoe sole as claimed in claim 1, wherein the synthetic plastics material contains a polyol component based on polyester, polybutadiene, isocyanate and an addition of inflating agent.

38. Shoe sole as claimed in claim 1, wherein the synthetic plastics material contains a polyol component based on polyether, polybutadiene, isocyanate and an addition of inflating agent.

39. Shoe sole as claimed in claim 1, wherein the lower sole portion has in an unmachined condition a hardness of 40 to 60 Shore A and in a machined condition a hardness of 20 to 40 Shore A.

40. Shoe sole as claimed in claim 1, wherein the lower sole portion has in an unmachined condition a hardness of 45 to 55 Shore A and in a machined condition a hardness of 25 to 35 Shore A.

41. Shoe sole as claimed in claim 1, wherein the lower sole portion extends till the top surface of the sole at least at the heel edge within the area of the rear portion of the sole.

42. Shoe sole as claimed in claim 41, wherein the upwardly extending part is, as seen in the top plan view of the top surface of the sole, arcuate in shape and gradually passes over to the side surface of the upper sole portion.

43. Shoe sole as claimed in claim 1, wherein the lower sole portion is at least partially extending above the top surface of the sole.

44. Shoe sole as claimed in claim 43, wherein the upwardly extending part is arranged within recesses on the side-surface of the upper sole portion.

45. Shoe sole as claimed in claim 1, wherein the upper sole portion consists of at least two parts being connected one with the other by means of intermediate parts.

46. Shoe sole as claimed in claim 45, wherein the intermediate parts form one single piece with the heel and with the lower sole portion.

47. Shoe sole as clamed in claim 1, wherein the lower sole portion is applied to the upper sole portion by foaming operation.

48. In the shoe sole of claim 1, said lower sole portion being secured to said upper sole portion in said front and rear sole sections by a forming operation.

49. In the shoe sole of claim 1, the portion of said lower sole portion located in the rear section of said shoe sole consisting mainly of a heel, said heel being integrally formed in said lower sole portion and being secured to said upper sole portion by a forming operation.

50. Shoe sole as claimed in claim 49, wherein the lower sole portion arranged within the area of the front sole section as well as the lower sole portion arranged within the area of the rear sole section are applied to the upper sole portion by foaming operation.

51. In the shoe sole as claimed in claim 1, at least a portion of said upper sole portion extending completely across said sole partially till the sole edge.

52. In the shoe sole of claim 1, the thickness of said lower sole portion increasing in a wedge-like manner in at least the area of said rear section.

53. In the shoe sole of claim 1, the bottom surface extending continuously from the toe area of said upper sole portion to the heel area thereof.

54. Shoe sole as claimed in claim 53, wherein the bottom surface of the upper sole portion is continuously upwardly and rearwardly inclined in at least the intermediate section of said sole.

55. In the shoe sole of claim 1, the longitudinal side edges of said upper sole portion defining the upper portions of the longitudinal side edges of said shoe sole.

56. In the shoe sole of claim 1, said lower sole portion defining the top surface of said sole in the area of the front tip of said sole.

57. Shoe sole as claimed in claim 56, wherein the upwardly extending part is, as seen in a top plan view of the top surface of the sole, arcuate in shape and gradually passes over to the side surface of the upper sole portion.

58. In the shoe sole of claim 1, a portion of said upper sole portion which is located adjacent the area of the ball of the foot being integrally formed with said lower sole portion from a plasticized polybutadiene cross linked by an isocyanate and being secured to the adjacent portions of the uppeer sole portion in a forming operation.

59. Shoe sole as claimed in claim 58, wherein the intermediate part of plasticized polybutadiene cross-linked with isocyanate is fixed to the upper sole portion by glueing.

60. Shoe sole as claimed in claim 58, wherein hollow microspheres, the thin shell of which consists of a vinylidene chloride copolymer and the core of which contains a gas, are contained in the intermediate part consisting of the plasticized polybutadiene cross-linked with an isocyanate.

61. A shoe sole comprising an upper sole portion and a lower sole portion which cooperate to substantially define front, intermediate and rear sections of said shoe sole construction, said upper sole portion consisting of a wood material and having top and bottom surfaces, the top surface of said upper sole portion defining the top surface of said shoe sole at least in the areas where it is contacted by the heel and by the ball of the foot of a wearer, said lower sole portion consisting of an elastic material and having upper and lower surfaces, the bottom surface of said upper sole portion being secured to the upper surface of said lower sole portion by a forming operation at least in the front and rear sections of said shoe sole, the thickness of said lower sole portion in the rear section of said shoe sole being at least 1.5 times the thickness of the lower sole portion in the front section of said shoe sole, the thickness of the lower sole portion within the area of the rear sole portion being greater than the thickness of the upper sole portion within the area of the rear section, the main portion of the rear section of the lower surface of said lower sole portion being defined by a substantially planar downwardly facing surface, at least the portion of said lower sole portion which is located in the rear section of said shoe sole consisting of a relatively hard, durable, wear-resistant, elastic synthetic plastic material having a cellular structure.

62. Shoe sole as claimed in claim 61, wherein the thickness of the lower sole section within the area of the rear sole section is, as measured in normal direction to the top surface of the sole, greater than twice the thickness of the upper sole portion within the area of the rear sole section.

63. A shoe sole comprising an upper sole portion and a lower sole portion which cooperate to substantially define front, intermediate and rear sections of said shoe sole construction, said upper sole portion consisting of a wood material and having top and bottom surfaces, the top surface of said upper sole portion defining the top surface of said shoe sole at least in the areas where it is contacted by the heel and by the ball of the foot of a wearer, said lower sole portion consisting of an elastic material and having upper and lower surfaces, the bottom surface of said upper sole portion being secured to the upper surface of said lower sole portion by a forming operation at least in the front and rear sections of said shoe sole, the thickness of said lower sole portion in the rear section of said shoe sole being at least 1.5 times the thickness of the lower sole portion in the front section of said shoe sole, the thickness of said lower sole portion in the ball area of said front section being at least one third of the total thickness of the sole in said ball area, the main portion of the rear section of the lower surface of said lower sole portion being defined by a substantially planar downwardly facing surface, at least the portion of said lower sole portion which is located in the rear section of said shoe sole consisting of a relatively hard, durable, wear-resistant, elastic synthetic plastic material having a cellular structure.

64. Shoe sole as claimed in claim 63, wherein the thickness of the lower sole portion within the area of the front sole section is, as measured in normal direction to the top surface of the sole, at least more than one half of the total sole thickness.

65. Shoe sole as claimed in claim 64, wherein the thickness of the lower sole portion within the ball area of the front sole portion is, as measured in normal direction the top surface of the sole, at least more than one half of the total sole thickness.

* * * * *